US011700960B2

(12) United States Patent
Alsofi

(10) Patent No.: US 11,700,960 B2
(45) Date of Patent: Jul. 18, 2023

(54) ADJUSTABLE-SIZE SERVING BOARD

(71) Applicant: Hosam Alsofi, Sindelfingen (DE)

(72) Inventor: Hosam Alsofi, Sindelfingen (DE)

(73) Assignee: SofiGOODs GmbH, Sindelfingen (DE)

( * ) Notice: Subject to any disclaimer, the term of this patent is extended or adjusted under 35 U.S.C. 154(b) by 107 days.

(21) Appl. No.: 17/447,826

(22) Filed: Sep. 16, 2021

(65) Prior Publication Data

US 2023/0084698 A1 Mar. 16, 2023

(51) Int. Cl.
*A47G 23/06* (2006.01)

(52) U.S. Cl.
CPC ..... *A47G 23/06* (2013.01)

(58) Field of Classification Search
CPC ..... A47G 23/06; A47G 23/0633
USPC ..... 206/557, 558, 565; 426/115
See application file for complete search history.

(56) References Cited

U.S. PATENT DOCUMENTS

2004/0037078 A1* 2/2004 Lee ..... A47G 23/06 362/249.01
2014/0110413 A1* 4/2014 Kelly ..... B63B 22/24 220/560
2016/0107791 A1* 4/2016 Schlief ..... A47G 23/06 220/4.28
2019/0254454 A1* 8/2019 Boyatt ..... B65D 71/0003
2022/0287492 A1* 9/2022 Siek ..... A47G 23/06

* cited by examiner

*Primary Examiner* — Jacob K Ackun
(74) *Attorney, Agent, or Firm* — Dunlap Bennett & Ludwig, PLLC

(57) ABSTRACT

A serving board that is convertible between a compact configuration and an expanded configuration is disclosed. The serving board includes a base board, a cover board, and side boards. The base board has a number of peripheral edge regions that have a first coupling element. The cover board may be provided as coupled to or integral with the base board on an upper side of the base board. The side boards each include a second coupling element and a third coupling element. Each side board detachably couples to the base board using the second and third coupling elements to result in a compact size serving board in a first configuration, and an expanded size serving board in a second configuration.

10 Claims, 5 Drawing Sheets

ADJUSTABLE-SIZE SERVING BOARD

BACKGROUND OF THE INVENTION

The present invention relates to serving boards and, more particularly, to a serving board that can be varied in size to accommodate different size gatherings.

Serving boards (also referred to as cheese boards) are used to present food in an artful way. They are used in professional settings, as well as home gatherings. Even when someone is hosting an informal private gathering for a small or large group of people, food presentation is very important to the overall ambiance of the event.

Most serving boards are fixed in shape in terms of area. They are either small for small gatherings (e.g., four people or less), or large for parties and other large gatherings. Large boards have the problem of being hard to store, take up too much space when a small board footprint is needed (e.g., there is limited counter space), and are harder to transport (as needed). Small serving boards do not have these problems, but they fail to be adequately sized for large gatherings. Consequently, hosts, at the present, need to have the two variations in size to be adequately prepared for different event sizes, or serve the food on multiple boards, which does not make for an artful presentation.

As can be seen, there is a need for a serving board that provides the functional benefits of both large and small serving boards, without the drawbacks previously described.

SUMMARY OF THE INVENTION

In one aspect of the present invention, a serving board includes: (1) a base board defining a plurality of peripheral edge regions, with each peripheral edge region including a first coupling element; (2) a cover board coupled to or integral with the base board on an upper side of the base board; and (3) a plurality of side boards, with each side board comprising a second coupling element and a third coupling element, and each side board is configured to detachably couple to the base board such that: (a) in a first serving board configuration, the second coupling element couples with one of the first coupling elements; and (b) in a second serving board configuration, the third coupling element couples with the one of the first coupling elements.

These and other features, aspects and advantages of the present invention will become better understood with reference to the following drawings, description and claims.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, one embodiment of the present invention is an adjustable-size serving board that can be converted selectively to a compact configuration or an expanded configuration. In preferred embodiments, the serving board includes a base board, a cover board, and side boards. The base board includes a number of peripheral edge regions that have a first coupling element. The cover board may be provided as coupled to or integral with the base board on an upper side of the base board. The side boards each include a second coupling element and a third coupling element. Each side board detachably couples to the base board using the second and third coupling elements to result in a compact size serving board in a first configuration, and an expanded size serving board in a second configuration.

Embodiments of the present invention will allow for a more customizable serving area. Advantageously, a plurality of side boards can be detached from a base board and then attached/interlocked at a different location on the base board (away from a center of the base board) to result in a more spacious serving board. At the same time, one or more bowls that are used to serve dips can be relocated to a different region of the board to allow easier accessibility. When expanded, the aesthetic of the serving board is preserved, while simultaneously allowing for a larger number of people to enjoy the food on the board. When less surface area for a serving board is needed, the plurality of side boards can again be detached from the base board and attached/interlocked at a location closer to a center of the base board.

While additional benefits to the present invention will be made apparent by the following disclosure, the teaching of the present invention yield a customizable, expandable serving board that is both functional and aesthetically pleasing. Embodiments of present invention accomplish, among others, the two following goals: (1) serving a larger number of guests and (2) being compact and easily storable. Never before has it been conceived nor accomplished to have two aesthetically-pleasing serving boards integrated into a single apparatus.

Figure 1:
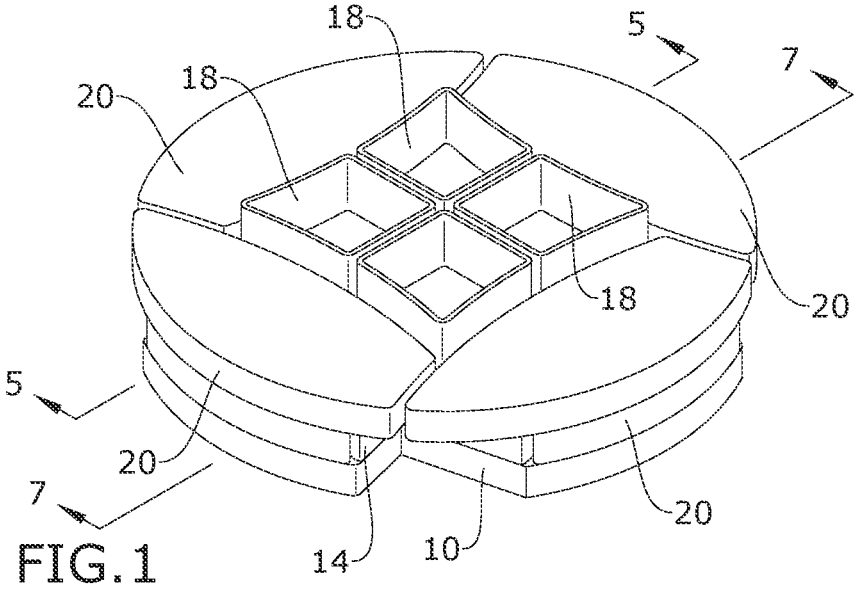
FIG. 1 is a perspective view of a first embodiment of the present invention, shown in a compact configuration.
Figure 2:
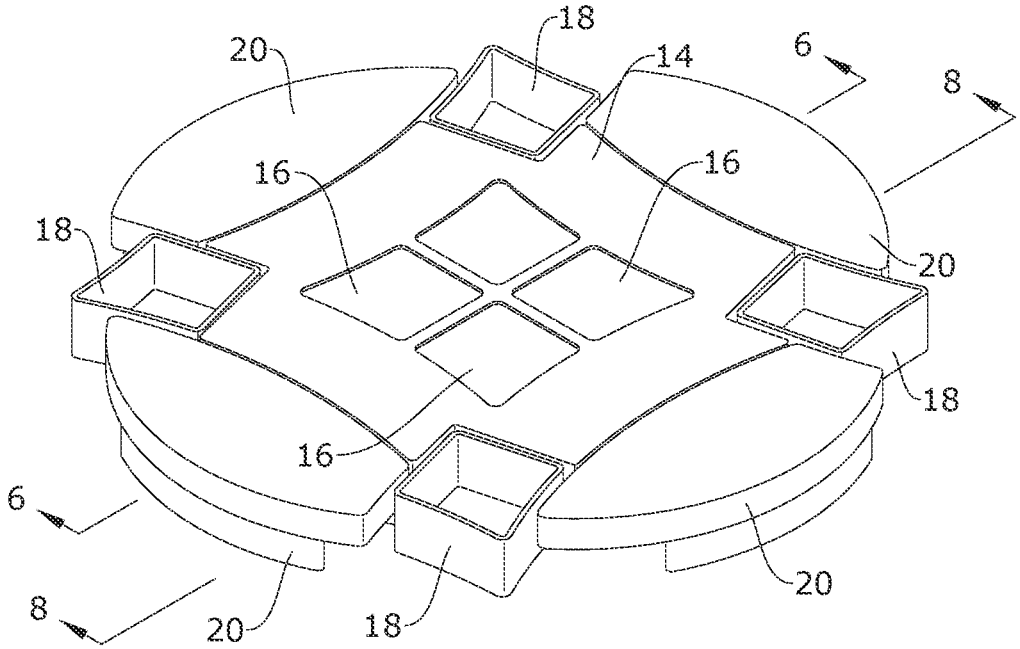
FIG. 2 is a perspective view of the first embodiment of the present invention, shown in an expanded configuration.
Figure 3:
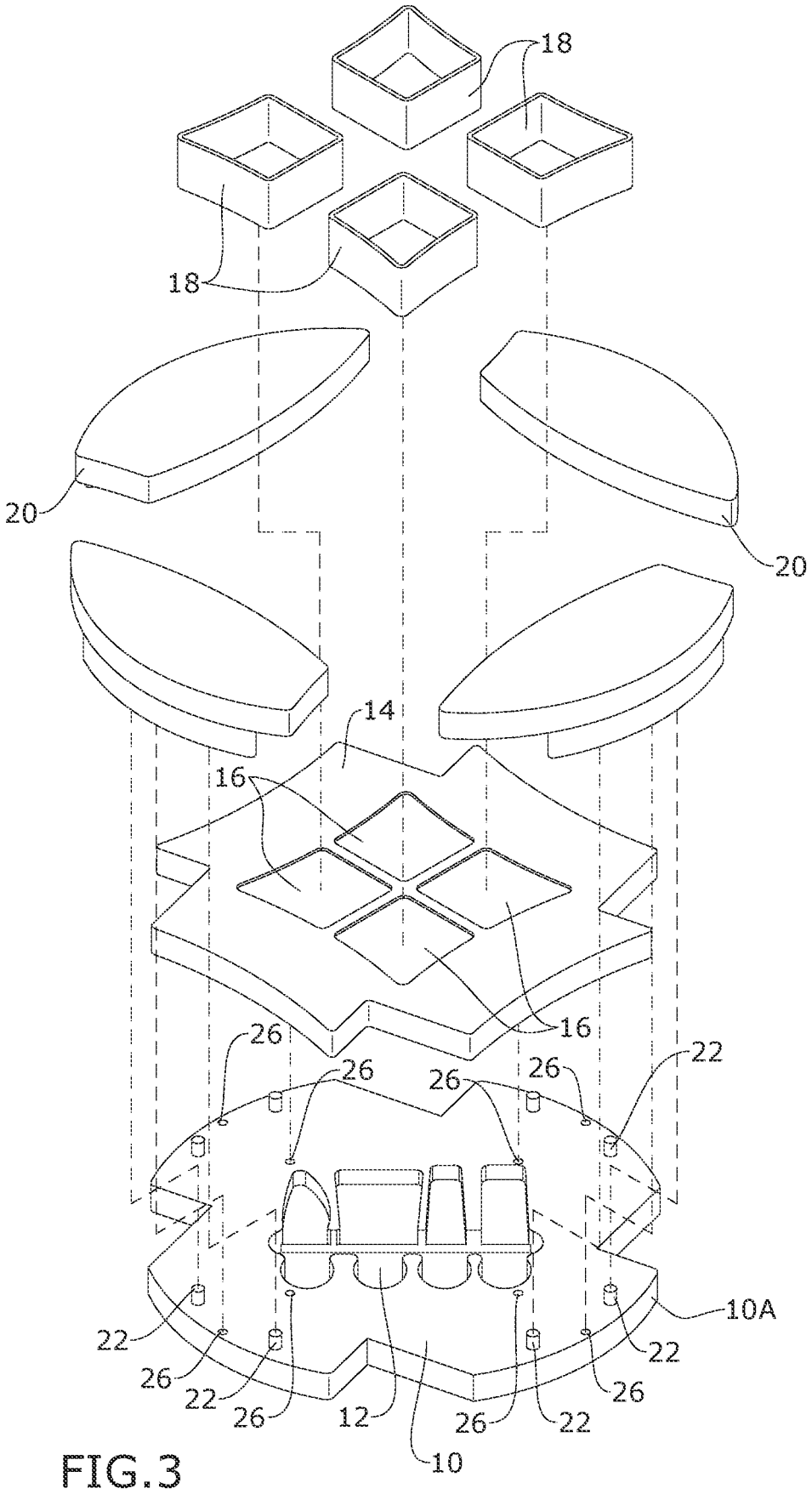
FIG. 3 is an exploded view of the first embodiment of the present invention, shown from a top perspective.
Figure 4:
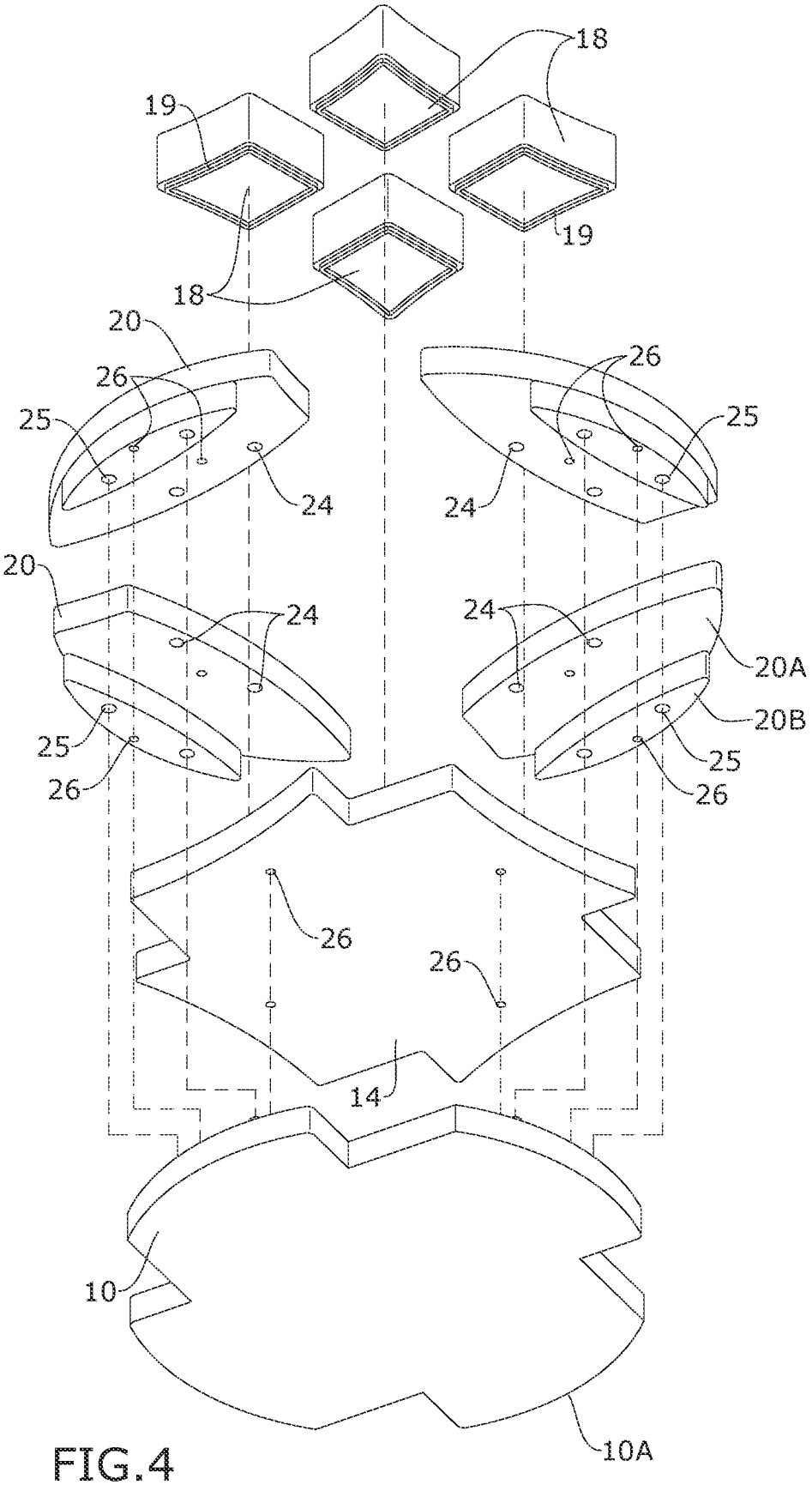
FIG. 4 is an exploded view of the first embodiment of the present invention, shown from a bottom perspective.
Figure 7:
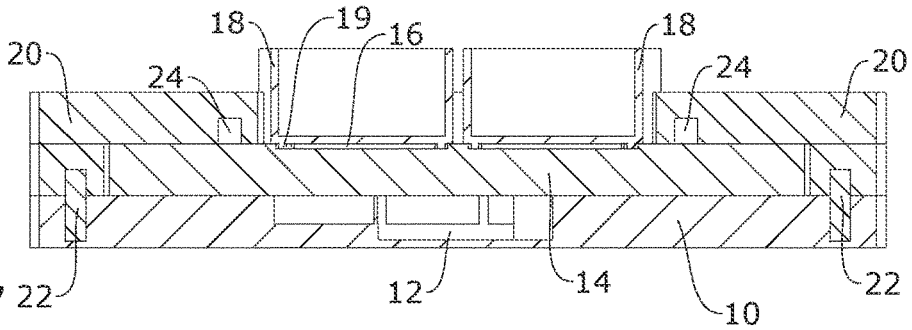
FIG. 7 is a section view of the first embodiment of the present invention, taken along line 7-7 in FIG. 1.

Making reference now to FIGS. 1 and 2, FIG. 1 generally shows a serving board of the present invention in a compact configuration, with FIG. 2 illustrating an expanded configuration of the serving board. Making reference now to FIG. 3, the serving board, in accordance with the present invention, includes a base board 10 that defines a plurality of shaped recesses 12 for storing knives and/or other serving tools. A cover board 14, in use, sits on top of the base board 10. The cover board 14 is provided with one or more bowl locating depressions 16 shaped for one or more bowls 18 to sit therewithin. In the illustrated embodiment, there are four bowls 18, but those with skill in the art will appreciate from the present disclosure that other embodiments may utilize a different number of bowls 18. As shown in FIGS. 4 and 7, each bowl 18 may include a lip 19 that securely mounts within a corresponding shaped recess 12. A plurality of side boards 20 are provided radially movable relatively to the rest of the assembly in a manner described in greater detail below. In preferred embodiments, the number of side boards 20 is the same as the number of bowls 18 to provide a symmetrical appearance in all configurations of the serving board.

As shown in FIGS. 3-6, the base board 10 and cover board 14 both include a plurality of magnets 26 that are complementarily positioned to retain the cover board 14 on top of the base board 10 while permitting detachment from one another to allow a user access to the knives and/or other serving tools that are retained in the shaped recesses 12. The cover board 14 is size and shaped to substantially cover the base board 10 while leaving peripheral edge regions 10A of the base board 10 exposed. It will be appreciated by those with skill in the art that, in certain embodiments, the cover board 14 and base board 10 may be integral with one another (i.e., embodied as a single piece) in embodiments where a storage compartment for knives/other tools is omitted.

Figure 8:
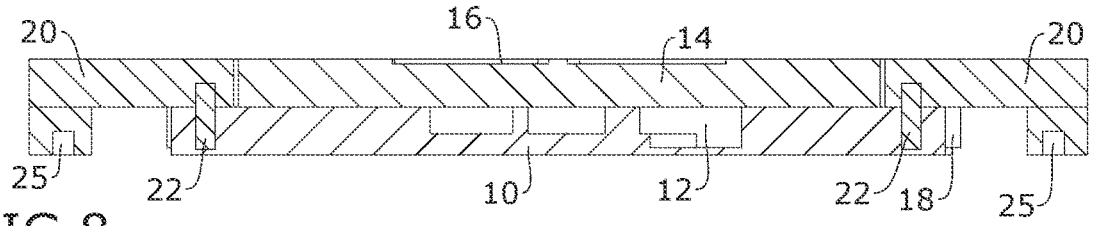
FIG. 8 is a section view of the first embodiment of the present invention, taken along line 8-8 in FIG. 2.

Referring now to FIG. 4, each side board 20 includes a side board upper member 20A and a side board lower member 20*b*. One or more holes are provided on undersurfaces thereof. In the illustrated embodiment of FIGS. 1-8, two upper pin holes 24 and two lower pin holes 25 are formed in the side board upper member 20A and the side board lower member 20*b*, respectively. However, it will be appreciated by those with skill in the art that various numbers and shapes of holes may be used in accordance with the present invention. As shown in FIG. 3, the peripheral edge regions 10A of the base board 10 include locating pins 22 that selectively engage the upper pin holes 24 and lower pin holes 25. FIG. 7, which illustrates a compact configuration of the serving board, shows the locating pins 22 engaging the lower pin holes 25. FIG. 8, which illustrates an expanded configuration of the serving board, shows the locating pins 22 engaging the upper pin holes 24. Like the pin holes 24, 25, the locating pins 22 may be embodied in various forms (such as other shaped-projections). Further, in certain embodiments, other coupling elements, like strong magnets, may be sufficient to retain the side board 20 in engagement with the base board 10 rather than using a locating pin 22 and hole 24, 25 arrangement. Similar to the engagement between the base board 10 and the cover board 14, and as shown in FIGS. 5 and 6, the peripheral edge regions 10A, the side board upper member 20A, and the side board lower member 10*b* may include magnets 26 embedded therewithin to better retain the locating pins 22 within either the upper pin holes 24 or the lower pin holes 25.

By way of example, a method of converting the serving board from a small board in the compact configuration (FIG. 1) to a large board in the expanded configuration (FIG. 2) will now be described. It will, of course, be appreciated that the reverse steps would result in the serving board going from an expanded configuration to a compact configuration. In the compact configuration, the one or more bowls 18 sit in the one or more bowl locating depressions 16. As shown in FIGS. 1, 5 and 7, a bottom surface of the side board upper member 20A sits on the cover board 14, and a bottom surface of the side board lower member 20*b* sits on the base board 10. In this position, the magnets 26 on the side board lower member 20*b* and the base board 10 are aligned, and the locating pins 22 are nested in the respective lower pin holes 25. Top surfaces of the side boards 20 sit in a raised position and substantially flush with one another. Further, an inner surface of the side board lower member 20*b* sits substantially flush with an outer surface of the cover board 14.

To convert the serving board to a large board (i.e., one with a larger surface area and greater perimeter than that of the small serving board configuration), each side board 20 is detached from the base board 10 by lifting the side board 20 up such that the locating pins 22, lower pin holes 25, and magnets 26 are no longer coupled with one another. Next, as shown in FIGS. 2, 6 and 8, each side board 20 is moved radially outward and positioned in the following manner. The upper pin holes 24 are aligned with the locating pins 22, and the locating pins 22 are set therein. In this position, the top surfaces of the side boards 20 sit in a lowered position are substantially flush with the top surface of the cover board 14. Additionally, as shown in FIG. 2, an inner surface of the side board upper member 20A sits substantially flush with the other surface of the cover board 14 due to a complementary contour design (the lower member 20*b* may also have this complementary contour design as well), resulting in a clean, aesthetically pleasing appearance for the larger serving board.

Figure 5:
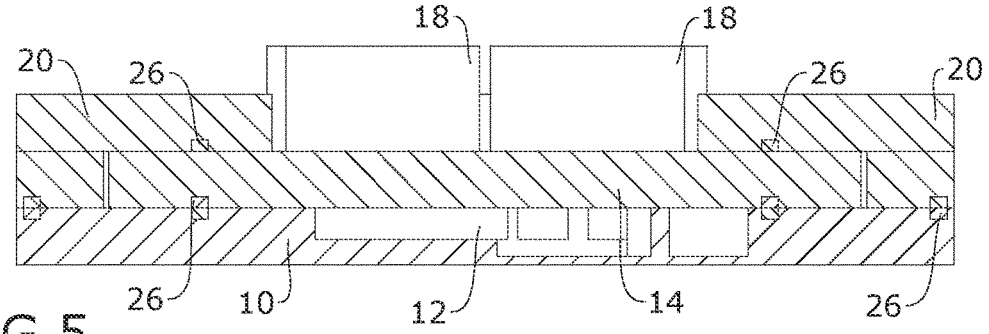
FIG. 5 is a section view of the first embodiment of the present invention, taken along line 5-5 in FIG. 1.
Figure 6:
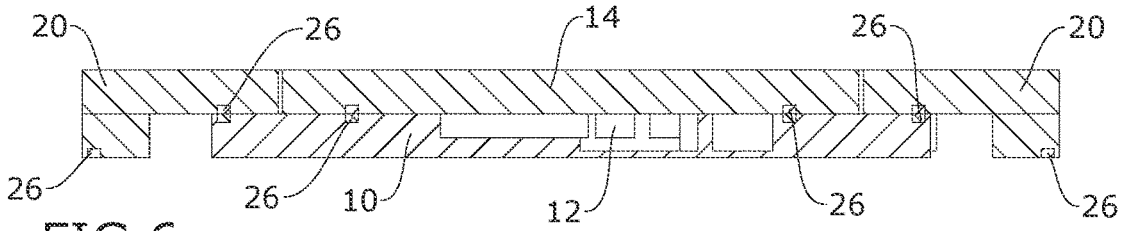
FIG. 6 is a section view of the first embodiment of the present invention, taken along line 6-6 in FIG. 2.

As shown, for example, in FIGS. 5 and 6, a height of the side board lower members 22*b* is substantially the same as that of the cover board 14 and the base board 10, so that it provides support to the rest of the side board in both the compact and expanded configurations. In the expanded position, the bottom surfaces of the side board lower members 26 sit on a support surface, such as a table, when the serving board is in use. As shown in FIG. 2, the side boards 20 and cover board 14 may be shaped such that the one or more bowls 18 can be moved from a center region of the serving board to along an outermost portion of the serving board, with each of the bowls 18 sitting in recessed defined between adjacent side boards 20 and at least partially by the cover board 14. As shown, because there is an equal number of bowls 18 and side boards 20, the bowls 18 fill every gap created when the side boards 20 are moved outwardly. Thus, an entire top surface of the serving board is available to be used for serving food.

Figure 9:
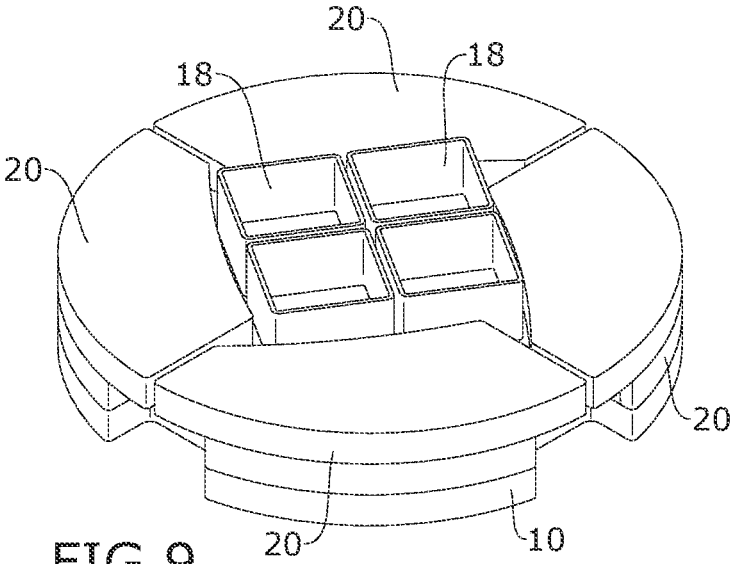
FIG. 9 is a perspective view of a second embodiment of the present invention, shown in a compact configuration.
Figure 10:
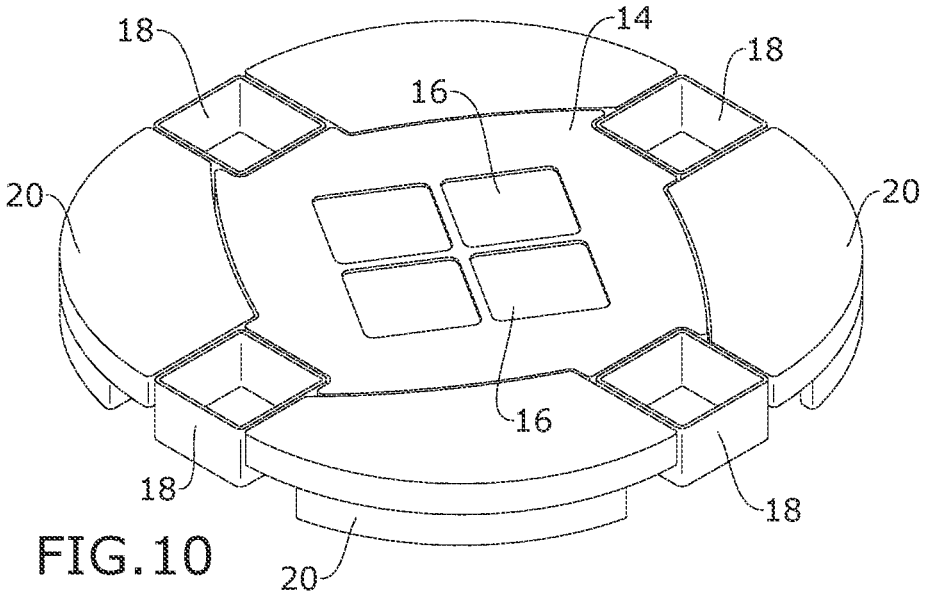
FIG. 10 is a perspective view of the second embodiment of the present invention, shown in an expanded configuration.

In general, all the parts can be geometrically shaped to provide a substantially continuous serving surface in both the compact and extended configurations. Many potential configurations are possible, and within the spirit and scope of the present invention. FIGS. 9 and 10 serve to demonstrate this concept, with the components being shaped different from the embodiment of FIGS. 1-8 while offering the same functionality as previously described.

To make various embodiments of the serving board, they may be formed, for example, from wood. Computer numerical control (CNC) machines may be used to cut and carve the wood, for example. In summary, converting the board into the expanded version will solve the problem of being small and not enough for parties. Converting the board into the compacted version will solve the problem of being too large for storage. It will also solve the problem of being too large for small gatherings. For instance, an entertainment of only two people (e.g., a romantic evening) will not require a large cheese server. The customizability described herein provides the advantages of different size boards with none of the disadvantages otherwise associated therewith.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

While apparatuses and methods are described in terms of "comprising," "containing," or "including" various components or steps, the apparatuses and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

The terms "inner" and "outer" are defined herein relative to the serving board. The term "inner" refers to the position of an element closer to the center of the serving board and the term "outer" refers to the position of an element further away from the center of the serving board. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A serving board comprising:

a base board defining a plurality of peripheral edge regions, with each peripheral edge region comprising a first coupling element;

a cover board coupled to or integral with the base board on an upper side of the base board; and a plurality of side boards, with each side board comprising a second coupling element and a third coupling element, and each side board is configured to detachably couple to the base board such that:

in a first serving board configuration, the second coupling element couples with one of the first coupling elements; and in a second serving board configuration, the third coupling element couples with the one of the first coupling elements.

2. The serving board of claim 1, wherein each side board is configured to move radially outwardly when being adjusted from the first serving board configuration to the second serving board configuration.

3. The serving board of claim 1, wherein a perimeter of the serving board in the first serving board configuration is smaller than a perimeter of the serving board in the second serving board configuration.

4. The serving board of claim 1, wherein each side board includes an upper member and a lower member, with the upper member comprising the third coupling element and the lower member comprising the second coupling element.

5. The serving board of claim 4, wherein each first coupling element comprises a first projection, and each second coupling element and each third coupling element defines a hole that is configured to receive one of the first projections.

6. The serving board of claim 4, wherein the cover board defines a plurality of lateral edges defining a first contour, and wherein an inner surface of each upper member defines a second contour complementary in shape as the first contour such that the plurality of side boards lay substantially flush with the cover board in the second serving board configuration.

7. The serving board of claim 1, further comprising a plurality of serving bowls, wherein there are an equal number of serving bowls and side boards.

8. The serving board of claim 7, wherein the plurality of serving bowls are configured to sit in a center region of the cover board in the first serving configuration, and wherein the plurality of serving bowls are each configured to sit between adjacent side boards, of the plurality of side boards, in the second serving configuration.

9. The serving board of claim 1, wherein each peripheral edge region defines a first outer surface with a first contour, and wherein each side board defines a second outer surface with a second contour, the first contour and the second contour being substantially the same.

10. The serving board of claim 1, wherein the cover board is detachably coupled to the base board to expose shaped recesses, defined in the base board, for storing knives or other serving tools.

* * * * *